US007495579B2

(12) United States Patent
Sirota et al.

(10) Patent No.: US 7,495,579 B2
(45) Date of Patent: Feb. 24, 2009

(54) TRAFFIC LIGHT STATUS REMOTE SENSOR SYSTEM

(76) Inventors: J. Marcos Sirota, 4 Crescent Pl., Takoma Park, MD (US) 20912; Antonios Seas, 9941 Carrigan Dr., Ellicott City, MD (US) 21042; David Mostofi, 7001 Georgia St., Chevy Chase, MD (US) 20815

( * ) Notice: Subject to any disclaimer, the term of this patent is extended or adjusted under 35 U.S.C. 154(b) by 573 days.

(21) Appl. No.: 11/151,377

(22) Filed: Jun. 13, 2005

(65) Prior Publication Data

US 2007/0008176 A1 Jan. 11, 2007

(51) Int. Cl.
*G08G 1/095* (2006.01)

(52) U.S. Cl. ..... 340/907; 340/931; 340/641; 246/473 R

(58) Field of Classification Search ..... 340/425.5, 340/457, 474, 907, 904, 915, 931, 936, 937, 340/942, 641; 246/473 R, 1 C, 473.1, 473.2, 246/473.3, 477, 483, 484, 486; 250/339.02, 250/349, 559.11, 206, 208.1; 701/19; 347/238; 362/800; 324/414
See application file for complete search history.

(56) References Cited

U.S. PATENT DOCUMENTS

| | | | | |
|---|---|---|---|---|
| 3,532,886 | A | 10/1970 | Kruger, Jr. et al. | 250/83.3 |
| 4,436,427 | A * | 3/1984 | Schwartz | 356/638 |
| 5,066,950 | A | 11/1991 | Schweitzer et al. | 340/937 |
| 5,321,490 | A | 6/1994 | Olson et al. | 356/5 |
| 5,546,188 | A | 8/1996 | Wangler et al. | 356/376 |
| 5,757,472 | A | 5/1998 | Wangler et al. | 356/4.01 |
| 5,793,491 | A | 8/1998 | Wangler et al. | 356/376 |
| 5,896,190 | A | 4/1999 | Wangler et al. | 356/4.01 |
| 6,111,523 | A | 8/2000 | Mee | 340/937 |
| 6,188,469 | B1 | 2/2001 | Liou et al. | 356/28 |
| 6,351,208 | B1 | 2/2002 | Kaszczak | 340/425.5 |
| 6,366,219 | B1 | 4/2002 | Hoummady | 340/907 |
| 6,373,402 | B1 | 4/2002 | Mee | 340/937 |
| 6,396,417 | B2 * | 5/2002 | Lee | 340/904 |
| 6,404,506 | B1 | 6/2002 | Cheng et al. | 356/634 |
| 6,466,260 | B1 | 10/2002 | Hatae et al. | 348/149 |
| 6,546,119 | B2 | 4/2003 | Ciolli et al. | 382/104 |
| 6,573,929 | B1 | 6/2003 | Glier et al. | 348/149 |
| 6,774,988 | B2 * | 8/2004 | Stam et al. | 356/218 |
| 6,985,073 | B1 * | 1/2006 | Doan | 340/425.5 |
| 7,123,165 | B2 * | 10/2006 | Davenport et al. | 340/931 |
| 2002/0012534 | A1 | 1/2002 | Kibayashi et al. | 396/205 |
| 2002/0054210 | A1 | 5/2002 | Glier et al. | 348/149 |
| 2002/0141618 | A1 | 10/2002 | Ciolli et al. | 382/104 |
| 2002/0186297 | A1 | 12/2002 | Bakewell | 348/118 |
| 2003/0020633 | A1 | 1/2003 | Lee | 340/907 |
| 2003/0080878 | A1 | 5/2003 | Kirmuss | 340/936 |

* cited by examiner

*Primary Examiner*—Anh V La
(74) *Attorney, Agent, or Firm*—Antonelli, Terry, Stout & Kraus, LLP.

(57) ABSTRACT

A Traffic-Light Status Remote Sensor System is disclosed. The basic system consists of a set of lenses, detectors, and narrowband filters. The sensor system is capable of determining the status of a traffic light (red, amber, or green) from a distance, without any connection to the electronic boards controlling the traffic light. A portable red-light photo-enforcement system working independently from the traffic light controllers is a potential application of the remote traffic light sensor.

26 Claims, 8 Drawing Sheets

TRAFFIC LIGHT STATUS REMOTE SENSOR SYSTEM

BACKGROUND OF THE INVENTION

1. Field of the Invention

This invention relates to a system and method for automatically determining the status of a traffic control signal and more particularly the invention relates to a system for monitoring and recording the status of a traffic signal by observing the light emitted from one or more traffic lights and using the resultant information as input to a traffic monitoring system in a controlled intersection.

2. Background of the Invention

Installing a red light photo-enforcement system in an intersection involves digging the road and pavement in order to install cables for interfacing the violation detecting/recording system with the traffic light controller for synchronization. This requirement makes the red light photo-enforcement system a permanent installation for a specific approach at an intersection. The disclosed invention eliminates the need for a cable connection between a light controller and a photo-enforcement system in order to communicate the status of the traffic signal. The state of the traffic signal can be determined remotely by using an optical system coupled to individual detectors or a CCD (charge-coupled device) image recorder as a remote traffic light sensor.

SUMMARY OF THE INVENTION

The disclosed system eliminates the installation costs associated with interfacing the traffic signal controller with Red Light Camera applications. In conjunction with non-intrusive speed estimation technologies (such as laser or video speed sensors), the remote sensor system makes possible the development of a fully transportable photo-enforcement system. This is a significant development for smaller municipalities and police departments who cannot afford to install photo-enforcement systems in many intersections.

Implementing a removable photo-enforcement system helps improve the efficiency of documenting red light violators. Another advantage of the disclosed remote system working in combination with a red-light photo-enforcement system is that the decision making process is based on exactly what a driver sees upon entering an intersection. If, for any reason, a traffic light is broken or hidden, and the driver cannot determine the state of the traffic light, neither will the sensor. In addition, immediate information about a light malfunction may be communicated to a control office, enabling immediate action to fix the light and/or dispatch personnel, thus increasing the safety of the intersection.

Another advantage of a transportable photo-enforcement red light system is the element of surprise to red light violators. In other words, when drivers realize that an intersection has been instrumented they tend to stop violating and the municipalities may lose money.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION

The invention summarized above and defined by the enumerated claims may be better understood by referring to the following description, which should be read in conjunction with the accompanying drawings. This description of an embodiment, set out below to enable one to build and use an implementation of the invention, is not intended to limit the invention, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
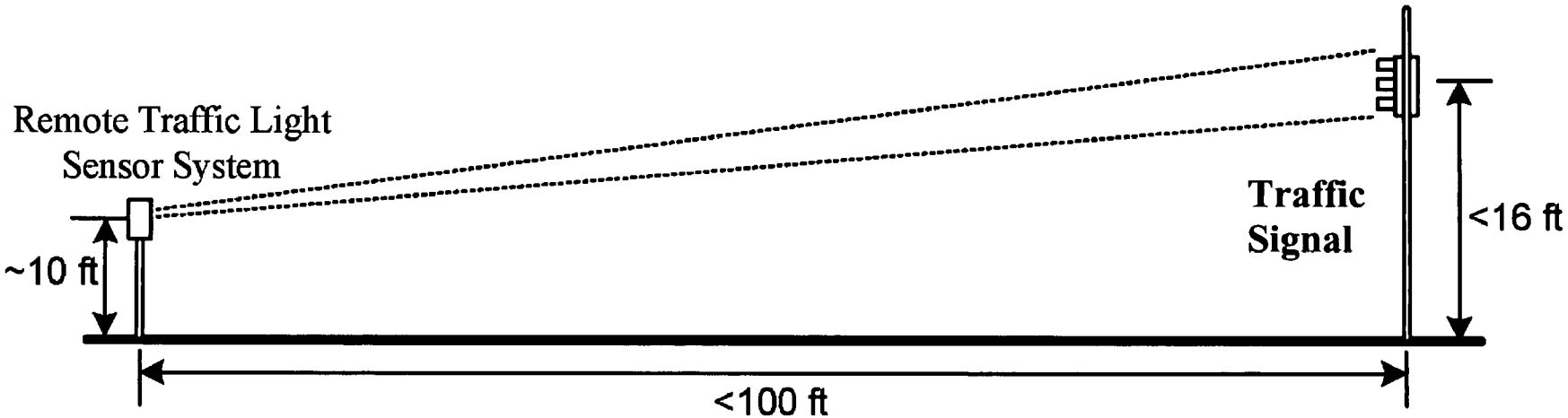
FIG. 1 illustrates a geometrical arrangement of a remote traffic light sensor according to a first embodiment of the present invention.

Referring now to the figures, the basic principle of operation of the disclosed sensor system is illustrated in FIG. 1, which shows the geometrical design of a remote traffic light sensor system. The traffic signal is usually installed at a sufficient height to enable tall vehicles, such as large trailer trucks to pass thereunder. The sensor should be installed at a sufficient height to avoid tampering and prevent blockage by vehicles, other structures, and vegetation. The distance between the remote sensor and traffic signal should be determined based upon a sufficient field of view of the lights of the traffic signal.

Figure 2:
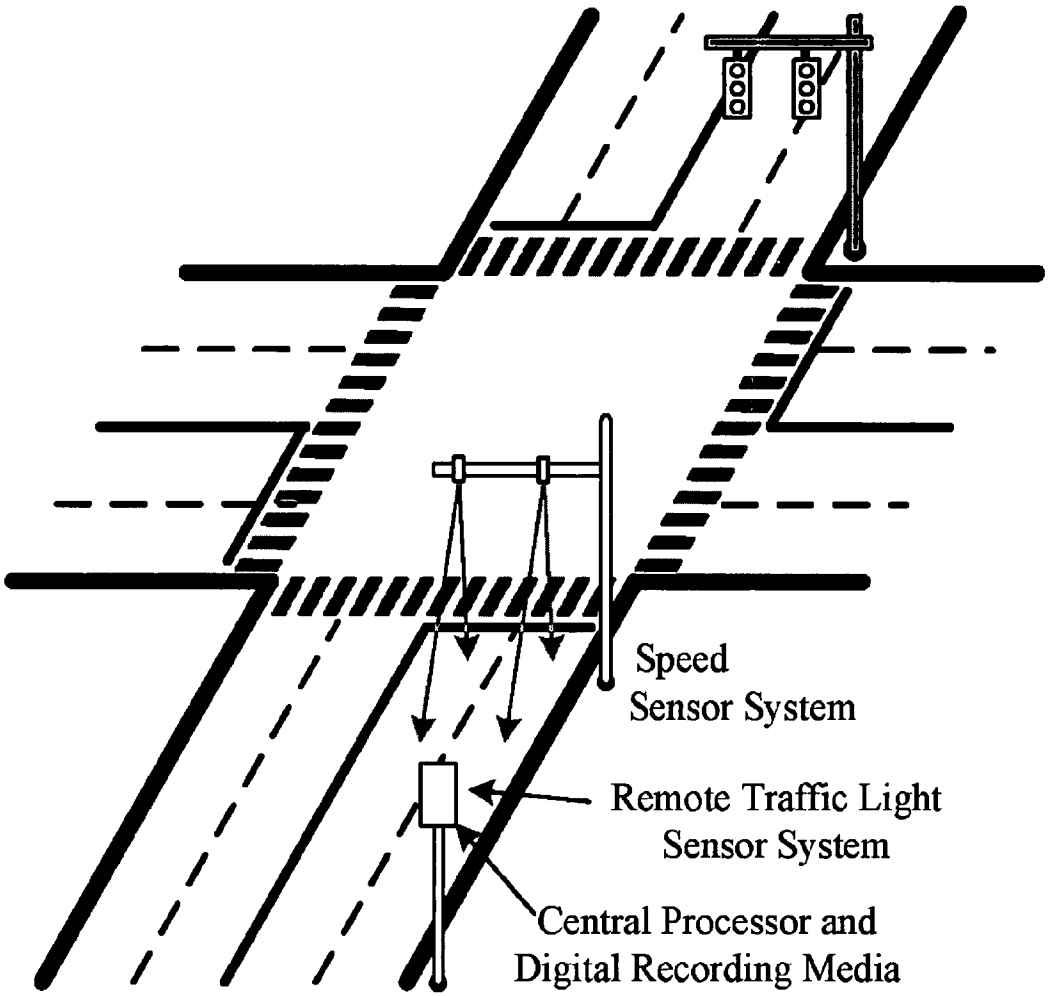
FIG. 2 illustrates a photo-enforcement system employing the remote traffic light sensor system according to an embodiment of the present invention.

FIG. 2 illustrates the geometric layout of a possible implementation of a photo-enforcement system employing the remote traffic light sensor of the present invention. Special attention should be given to the design of the optical system and its field of view. The exact optical design will depend on the layout of a specific intersection. It is desirable, however, that the field of view for each detector is about 2 to 3 times the size of the light to be monitored in order to eliminate false readings due to possible movement of the traffic signal enclosure.

Figure 3:
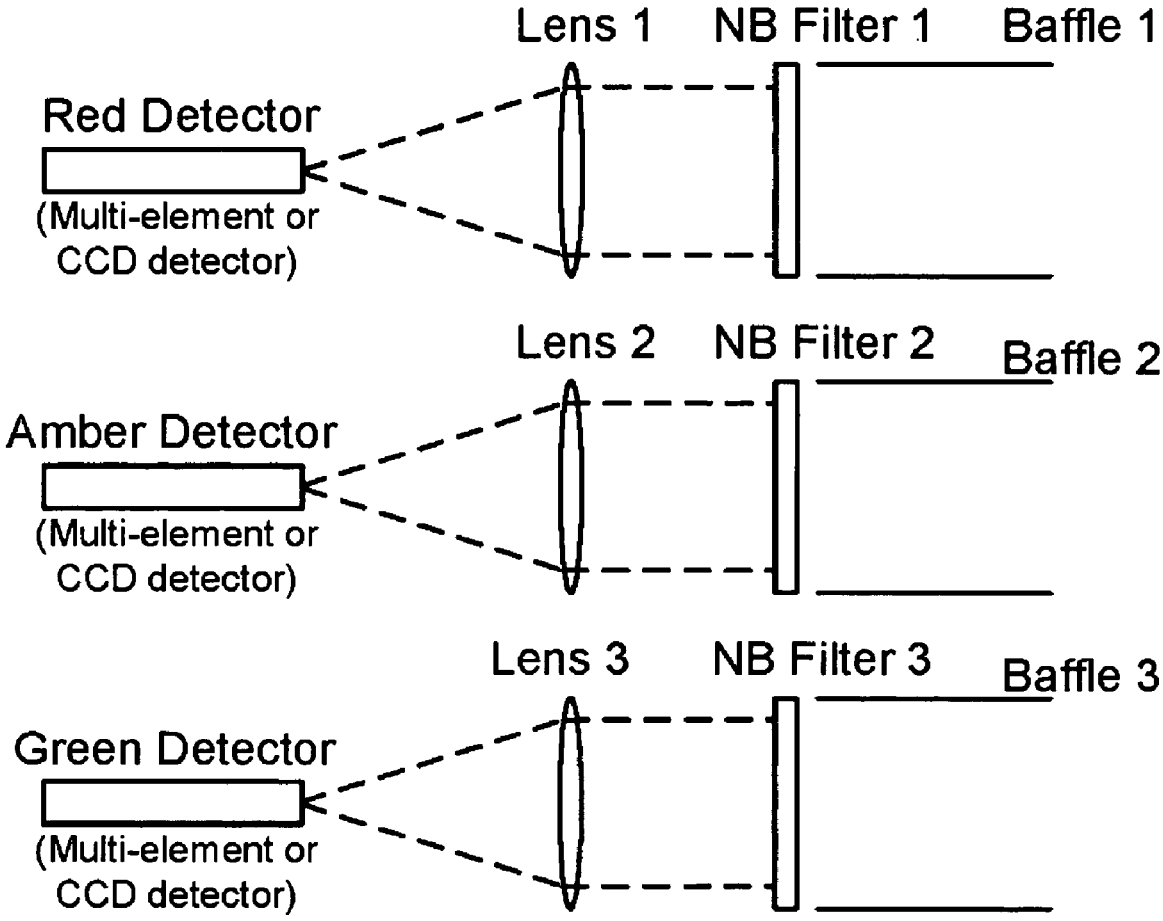
FIG. 3 shows a detector and filter arrangement according to a first embodiment of the present invention.

An optical arrangement of a remote traffic light status sensor is shown in FIG. 3. The sensor comprises three lenses, three detectors, and three narrow band transmission filters. Each combination of detector, lens, and narrowband filter is dedicated to detect a single light state (red, amber, or green), which is dictated by the pass band wavelength of the filter. A baffle surrounding the lens or filter helps prevent spurious, distracting light from interfering with operation of the detector. The detector can be a single element photo detector, a multi element photo detector, or a monochrome/color CCD detector, as described below.

Optical radiation from the traffic light is filtered by bandpass filters and is incident on only one of the lenses (since only one filter will allow light of a desired wavelength to pass through). The pass bands of the individual filters depend on the type of lights used in the signal device. In the case of LED (Light Emitting Diode) lights, a narrower bandpass filter can be used since the emission wavelength of LED lights is narrower as compared with traditional incandescent lights. The lens focuses the collected light onto a detector corresponding to a predetermined detected color and an electrical output is generated. The traffic signal status is determined according to which detector generates the output and the traffic signal status is communicated to one or more interfaced controllers.

Data collected and processed by the remote sensor system can generate useful information concerning the traffic signal under surveillance. Inspection of the traffic signal timing sequence can reveal whether the traffic signal is operated according to the rules and regulations of the local government.

Figure 4:
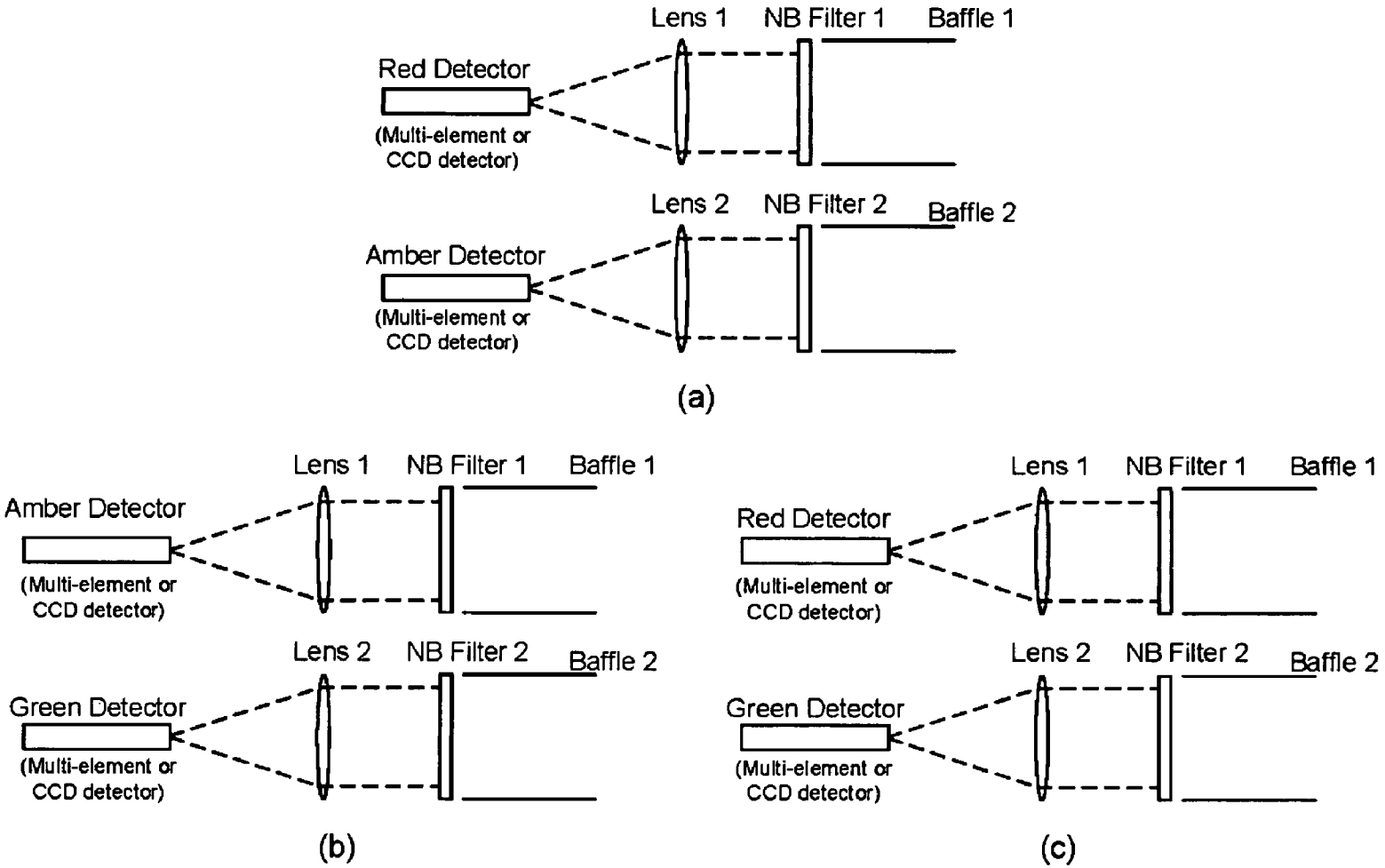
FIG. 4 shows detector and filter arrangements according to some alternate embodiments of the present invention.

In some embodiments, it is not necessary to employ three detectors. Other embodiments of the remote traffic light status sensor are shown in FIG. 4. For example, instead of using sets of three components, the systems shown employ only two sets of detectors. Part (a) shows use of only a red detector and an amber detector. It is assumed that absence of an output from both the red and amber detectors signifies that the third, green light is on. Part (b) shows use of only an amber detector and a green detector. It is assumed that absence of an output from both the amber and green detectors signifies that the third, red light is on. Part (c) shows use of only a red detector and a green detector. It is assumed that absence of an output from both the red and green detectors signifies that the third, amber light is on. Any one of such arrangements can be used as a cost-saving measure while maintaining an accurate, logical output.

Figure 5:
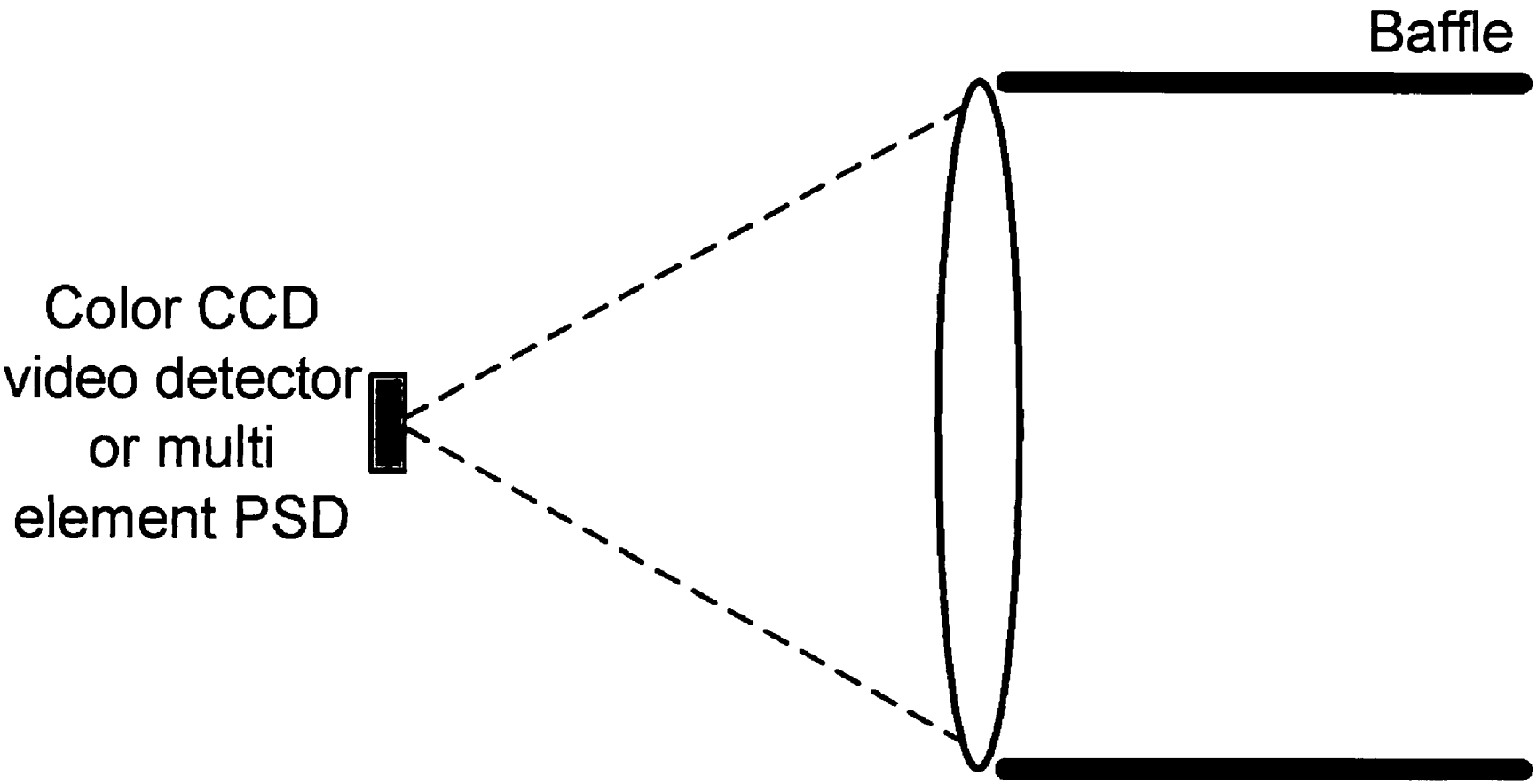
FIG. 5 shows a detector arrangement for a multi element position sensitive detector according to an embodiment of the present invention.

Instead of using individual detectors, lenses, and filters to determine the state of the traffic light, the disclosed system can be constructed using a single lens and a color video CCD detector or a multi element position sensitive detector (PSD). This system is schematically shown in FIG. 5. Of course, the robustness of the sensor system is improved by using multi-element photo detectors or monochrome CCD detectors in place of a single element photo detector. Furthermore, color CCD detectors eliminate the need for a bandpass filter in front of every detector.

Figure 6:
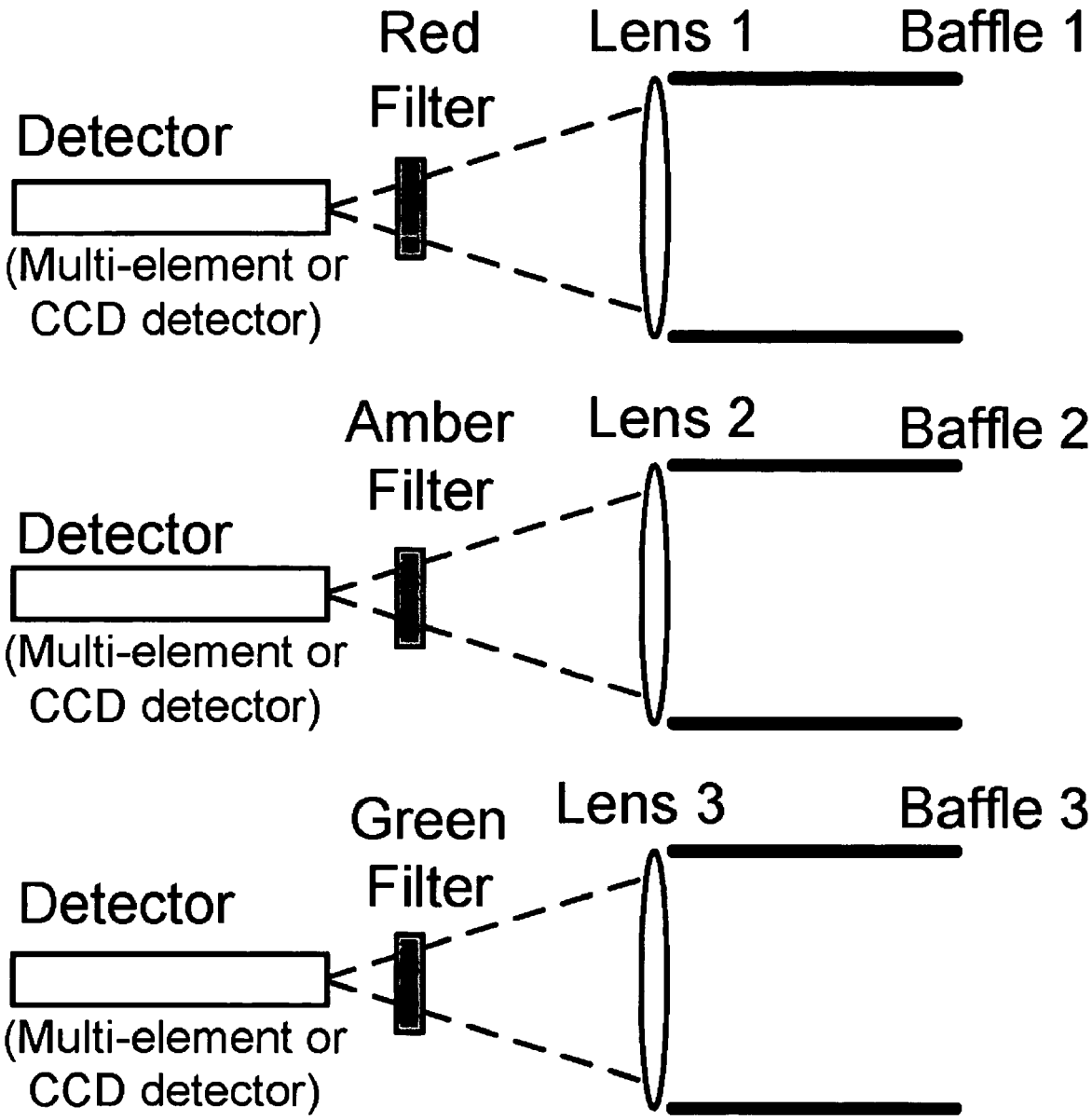
FIG. 6 shows an alternate detector and filter arrangement according to another embodiment of the present invention.

In an alternate embodiment, the narrowband filter is placed between the lens and the detector resulting in a smaller filter size. This option, shown in FIG. 6, reduces the construction cost since, in general, the cost of a narrowband filter is proportional to its size.

Detection of the light status using the setup shown in FIG. 5 can be accomplished using a series of algorithms. In the algorithms the state of the individual pixels in the two dimensional detectors is considered. The algorithms used for initialization and operation of the remote traffic light status sensor system are illustrated in FIGS. 7 and 8.

Figure 7:
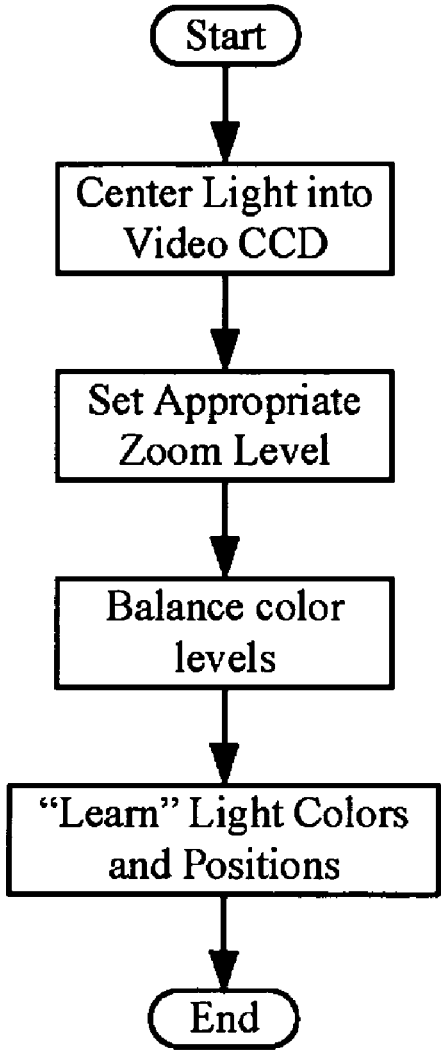
FIG. 7 is a flowchart for an Installation/Calibration Algorithm of a remote traffic light status sensor system according to a first embodiment of the present invention.
Figure 8:
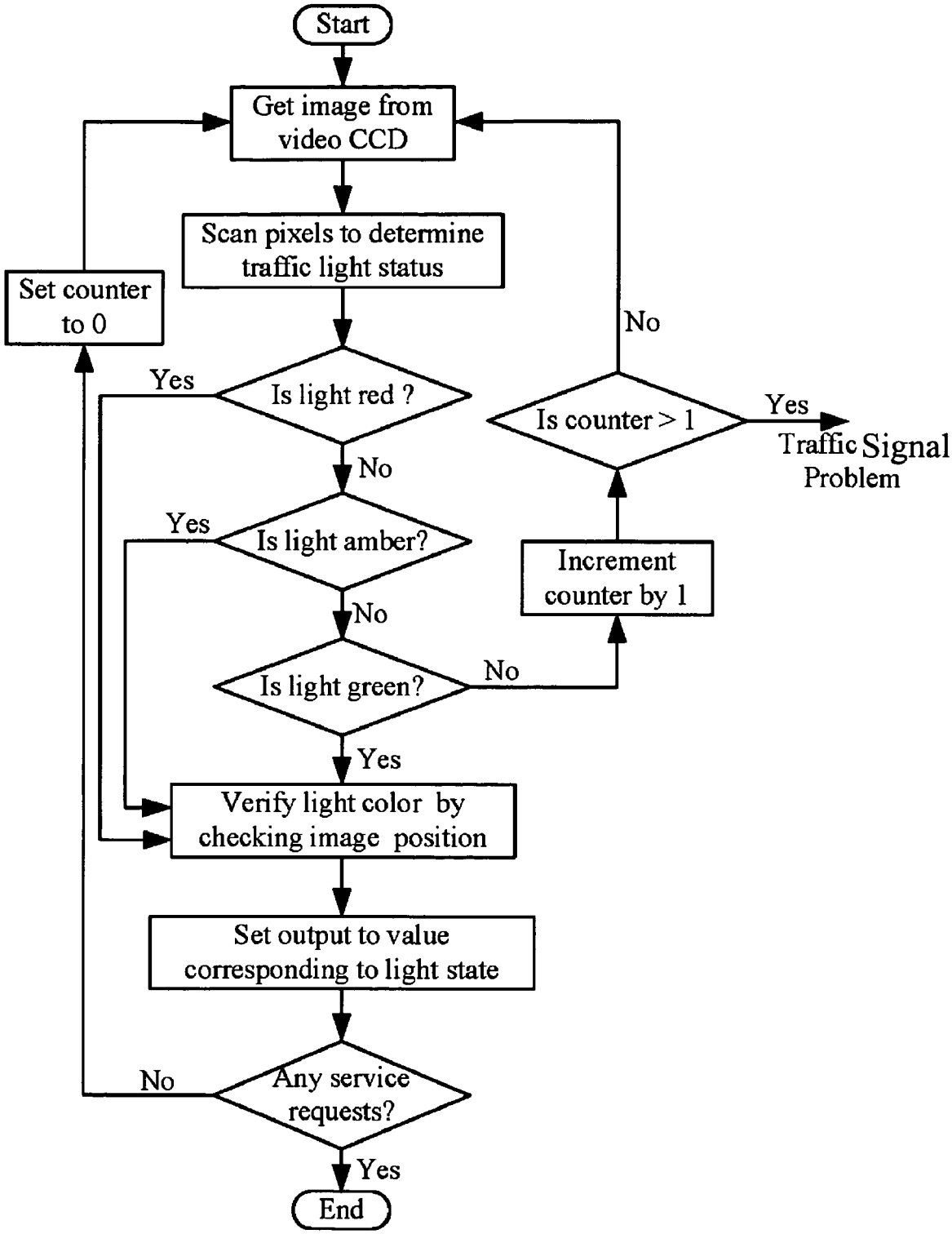
FIG. 8 is a flowchart for an Operation Algorithm of a remote traffic light status sensor system according to a first embodiment of the present invention.

As shown in FIG. 7, upon installation of the remote traffic light sensor, a routine is executed in order to initialize and calibrate the sensor system. A more precise explanation of the processes during the various steps involved is listed in table 1.

TABLE 1

| Installation/Calibration Algorithm of the remote traffic light status sensor system | |
|---|---|
| Step 1 | Start the "Installation/Calibration" algorithm. |
| Step 2 | Center the image of the whole traffic light onto the video CCD. This is accomplished by aligning a three-circle reference to the recorded image. |
| Step 3 | Set appropriate zoom so that the traffic light is at the center of the CCD and its height occupies about half the size of the CCD. |
| Step 4 | Balance the color levels and brightness intensity for optimum results. |
| Step 5 | Learn the light colors and positions. This is accomplished by recording the color corresponding to each state and saving it as reference. The position of the three-circle reference is also recorded for use during normal operation of the sensor system. |
| Step 6 | End the "Installation/Calibration" algorithm. |

The algorithm shown in FIG. 8 and explained in Table 2 illustrates the normal operation of the sensor and how the traffic light status is detected.

TABLE 2

| Operational algorithm of the remote traffic light status sensor system | |
|---|---|
| Step 1 | Start the "Operational" algorithm. |
| Step 2 | Get a digital image file of the traffic signal from the video CCD. |
| Step 3 | Scan the pixels corresponding to the image to determine the status of the traffic signal. |
| Step 4 | Check whether the red light is illuminated. If the light is red then proceed to verify the red-light status by checking the position of the light relative to the whole image. If the light is not red then proceed to next step. |
| Step 5 | Check whether the amber light is illuminated. If the light is amber then proceed to verify the amber-light status by checking the position of the light relative to the whole image. If the light is not amber then proceed to next step. |
| Step 6 | Check whether the green light is illuminated. If the light is green then proceed to verify the green-light status by checking the position of the light relative to the whole image. If the light is not green then increase a counter by 1 (i.e. raise a flag since the traffic light is not in any of the possible states and it may have malfunctioned). If the counter is greater than 1 then issue a "Traffic Light Service Request". If not then start the algorithm again by getting an image from the video CCD. |
| Step 7 | Set output to a state corresponding to the traffic signal state. |
| Step 8 | Check whether any service request has been issued. If yes then end, else proceed to next stage. |
| Step 9 | Clear the contents of the counter. |
| Step 10 | Start the algorithm again by getting a digital image from the video CCD. |

The system is specifically useful for Red-Light Camera violation detection. In operation, the speed of passing vehicles is estimated using a traffic sensor system and the status of the traffic light is detected by the remote traffic light sensor system described herein. In a preferred embodiment, the remote traffic light sensor system is located in the same housing as the recording media, which may be a digital camera or other appropriate recording device. The remote traffic light status system provides input to a controller/CPU in the violation detection system about the traffic signal status. This input together with speed estimated provided by the traffic sensor system is used to make a decision whether a violation is about to occur. If a violation is likely, the controller/CPU initiates a series of recordings for documenting the violation.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A transportable traffic photo-enforcement system comprising:

a remote sensor arranged to detect a status of a traffic control signaling device, and a recording device incorporating at least one recording medium, wherein the remote sensor and the recording device are collocated and supported by a common supporting structure, the remote sensor is arranged remotely in a line of sight of the traffic control signaling device, and the transportable traffic photo-enforcement system is arranged to have no wired connections or dedicated data conduits between the transportable traffic photo-enforcement system and the traffic control signaling device.

2. The transportable traffic photo-enforcement system of claim 1, wherein the remote sensor is arranged to observe the traffic control signal device having an unobstructed field of view substantially centered on the traffic control signal device, the field of view being at least two times an observed size of the traffic control signaling device.

3. The transportable traffic photo-enforcement system of claim 1, wherein the digital recording device includes a digital camera and the recording medium is a digital recording medium.

4. The transportable traffic photo-enforcement system of claim 3, wherein the digital camera includes a color CCD detector, the recording medium is a digital color image recording medium, and the color CCD detector and the recording medium are arranged to detect the status of the traffic control signaling device using a color of a plurality of pixels on at least one digital color image recorded on the digital color image recording medium.

5. The transportable traffic photo-enforcement system of claim 1, wherein traffic photo-enforcement system further comprises a speed sensor system arranged to measure a speed of vehicles participating in a traffic controlled by the traffic control signaling device.

6. The transportable traffic photo-enforcement system of claim 5, wherein the recording digital recording device further includes a Central Processor Unit arranged to receive a data set including the detected status of the traffic control signaling device and the speed measured by the speed sensor system, process the data set to generate a trigger for the recording device to initiate and store a series of recordings on the recording medium of a condition of the traffic regulated by the traffic control signal.

7. The transportable traffic photo-enforcement system of claim 6, wherein the Central Processor Unit is arranged to identify at least one vehicle associated with the speed measured by the speed sensor and the status of the traffic control signaling device, receive a data set on the detected status of the traffic control signaling device and the speed of the identified vehicle measured by the speed sensor system, process the data set to generate a trigger for the recording device to initiate and store the series of recordings on the recording medium of a relative position between traffic control signal and the identified vehicle as a function of time and the detected status of the traffic control signaling device.

8. A transportable traffic photo-enforcement system comprising:

a remote traffic light sensor arranged to detect a status of a traffic light, and a recording device incorporating at least one recording medium, wherein the remote sensor and the recording device are collocated and supported by a common supporting structure placed remotely in a line of sight of the traffic light having no wired connections or dedicated data conduits between the transportable traffic photo-enforcement system and the traffic light.

9. The transportable traffic photo-enforcement system of claim 8, wherein the remote traffic light sensor comprises:

a light detector, at least one lens, and a filter selected to allow a substantially single color light to pass therethrough, wherein the light detector provides an output upon receiving the single color light.

10. The transportable traffic photo-enforcement system of claim 9, wherein the substantially single color light is selected from the group consisting of:

amber, red, and green.

11. The transportable traffic photo-enforcement system of claim 9, wherein the filter is placed between the light detector and the lens.

12. The transportable traffic photo-enforcement system of claim 9, wherein the lens is placed between the light detector and the filter.

13. The transportable traffic photo-enforcement system of claim 9, wherein the light detector is selected from the group consisting of:

a single element photo detector, a multi-element photo detector, a monochrome charge-coupled device video detector, a and color charge-coupled device video detector.

14. The remote traffic light sensor of claim 8, comprising:

a first light detector and a second light detector, at least one lens for each of the first light detector and the second light detector, a first filter associated with the first light detector selected to allow a first substantially single color light to pass therethrough, and a second filter associated with the second light detector selected to allow a second substantially single color light to pass therethrough, the second substantially single color light being different than the first substantially single color light, wherein the first and the second light detectors provide an output upon receiving the first and the second substantially single color light respectively.

15. The remote traffic light sensor according to claim 14, wherein the first and second filters comprise narrowband filters.

16. The remote traffic light sensor according to claim 14, wherein at least one of the first and second filter is placed between its associated detector and lens.

17. The remote traffic light sensor according to claim 14, wherein the at least one lens for each of the first and second detector is placed between its associated detector and filter.

18. The remote traffic light sensor according to claim 14, wherein the first and the second filters are selected from the group consisting of:

a red light filter and a green light filter, a red light filter and an amber light filter, and an amber light filter and a green light filter.

19. The remote traffic light sensor according to claim 14, wherein the first and second detector is selected from the group consisting of:

a single element photo detector, a multi-element photo detector, a monochrome charge-coupled device video detector, and a color charge-coupled device video detector.

20. The remote traffic light sensor according to claim 14, further comprising:

a third light detector, at least one lens for the third light detector, and a third filter associated with the third light detector selected to allow a third substantially single color light to pass therethrough, the third substantially single color light being different than the first and second substantially single color light, wherein the first, second, and third light detectors provide an output upon receiving the substantially single color light.

21. A remote traffic light sensor of claim 8, comprising:

at least one lens, a position sensitive detector, and a three-circle reference, wherein the three-circle reference is aligned to permit light from each of three traffic signal lights to pass through one of the circles before the light is detected by the position sensitive detector.

22. The remote traffic light sensor according to claim 21, wherein the position sensitive detector provides an output indicative of which light of the traffic signal is illuminated based upon the location of light in the three-circle reference.

23. A transportable traffic photo-enforcement method comprising:

arranging a remote sensor to detect a status of a traffic control signaling device and a collocated recording device, incorporating at least one recording medium and a Central Processor Unit, to be supported by a common transportable supporting structure in a line of sight of a traffic control signal device;

arranging a speed sensor to measure speed of at least one vehicle participating in a traffic controlled by the traffic control signal device;

establishing a data connection for data exchange between the Central Processing Unit and the speed sensor;

measuring speed of at least one vehicle identified as participating in a traffic controlled by the traffic control signal device and detecting the status of the traffic control signaling device;

sending a data set including the detected status of the traffic control signaling device and the speed of the identified vehicle to the Central Processing Unit;

processing the data set by the Central Processing Unit to generate a trigger for the recording device;

triggering the recording device and storing a series of recordings on the recording medium of a relative position between traffic control signal and the identified vehicle as a function of time and the detected status of the traffic control signaling device.

24. A transportable traffic photo-enforcement method of claim 23, wherein processing the data set by the Central Processing Unit comprises a calculation of a probability for the identified vehicle to violate traffic regulations based upon the status of the traffic control signal device, and wherein the trigger is generated according to the calculated probability.

25. A transportable remote traffic light status sensor calibration method comprising:

starting the sensor calibration procedure;

centering and recording an image of an entire traffic light onto a video CCD of the sensor;

aligning a three-circle reference to the recorded image;

setting the CCD video zoom so as the traffic light is at the center of the CCD video recording and its height occupies about half the size of the CCD;

balancing a color levels and a brightness intensity;

learning the light colors and positions by recording colors corresponding to each state of the traffic light and saving it as reference, and recording position of the three-circle reference;

ending the calibration procedure.

26. A transportable remote traffic light status sensor operation method comprising:

arranging remote traffic light status sensor to image a traffic light;

gating a digital image file of the traffic signal from the video CCD;

scanning a pixels corresponding to the digital image to determine the status of the traffic signal;

checking whether the red light is illuminated, and if the light is red then proceeding to verify the red-light status by checking a position of the red light relative to the entire digital image, and if the light is not red then proceeding to next step;

checking whether the amber light is illuminated, and if the light is amber then proceeding to verify the amber-light status by checking a position of the amber light relative to the entire digital image, and if the light is not amber then proceeding to next step;

checking whether the green light is illuminated, and if the light is green then proceeding to verify the green-light status by checking a position of the green light relative to the entire digital image, and if the light is not green then increasing a count of a counter by 1 and if the count is greater than a predetermined number generating a service request, if not then starting the operation again by getting a new digital image from the video CCD;

setting an recording an output to a state corresponding to the verified traffic signal state;

checking whether any service request has been issued, if yes then end, else proceeding to next stage;

clearing the contents of the counter;

starting the algorithm again by getting a new digital image from the video CCD.

* * * * *